United States Patent [19]

Rosen

[11] Patent Number: 4,711,307

[45] Date of Patent: Dec. 8, 1987

[54] COMPACT SELF-CONTAINED FIRE EXTINGUISHER

[76] Inventor: Harold Rosen, 3 Morwood, St. Louis, Mo. 63141

[21] Appl. No.: 15,528

[22] Filed: Feb. 5, 1987

Related U.S. Application Data

[63] Continuation of Ser. No. 735,835, May 20, 1985, abandoned.

[51] Int. Cl.[4] ..... A62C 35/02

[52] U.S. Cl. ..... 169/57; 169/26; 169/54

[58] Field of Search ..... 169/19, 26, 51, 56, 169/57, 59, 60, 54, 58, 61, 70; 116/207, 216; 40/2 R, 312; 239/583

[56] References Cited

U.S. PATENT DOCUMENTS

| | | | |
|---|---|---|---|
| 1,402,711 | 1/1922 | Boyle | 169/46 |
| 1,604,380 | 10/1926 | Boyce | 169/57 |
| 1,616,974 | 2/1927 | Josephson | 169/57 X |
| 1,961,567 | 6/1934 | Nelson | 169/26 |
| 3,403,733 | 10/1968 | Terry | 169/49 |
| 3,446,286 | 5/1969 | Kreidler | 169/26 |
| 3,844,478 | 10/1974 | Davis | 239/60 X |
| 4,124,163 | 11/1978 | Siegmann | 239/683 X |
| 4,459,046 | 7/1984 | Spirg | 116/207 X |
| 4,560,109 | 12/1985 | Teruyuki et al. | 239/583 |

*Primary Examiner*—Jeffrey V. Nase

*Attorney, Agent, or Firm*—Kalish & Gilster

[57] ABSTRACT

A fire extinguisher of compact, self-contained character is installed in electrical equipment by being mounted within an aperture of a housing for the equipment. The extinguisher has an elongated vessel for containing under pressure a fire extinguishing substance such as halogenated hydrocarbon type. A nozzle is carried at one end of the vessel and is closed by fusible material which melts at a predetermined temperature to permit discharge into the housing. The nozzle is formed as part of a fitting which carries a washer-like disc having an adhesive substance on it to permit adhesive securement of the extinguisher to the equipment housing, with the greatest portion of the vessel extending exteriorly of the housing and only a small portion of the extinguisher thus extending interiorly of the housing. The vessel has a relatively high aspect ratio, such as permitting it to be installed in an aperture defined by an electrical knock-out. The arrangement permits instalation in receptacle boxes, breaker boxes and various domestic and comercial electrical equipment.

11 Claims, 5 Drawing Figures

FIG. 1
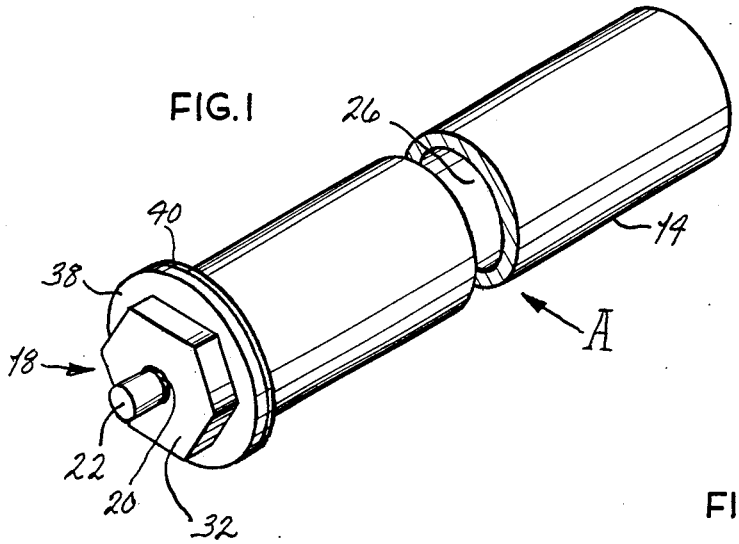
FIG. 2
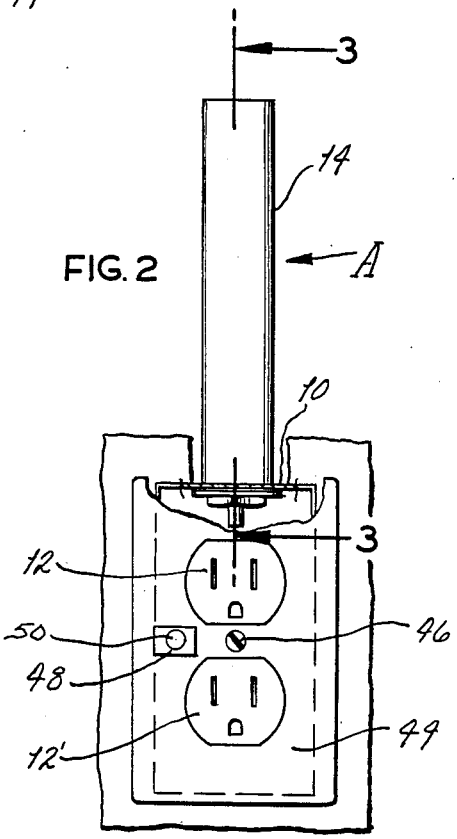
FIG. 3
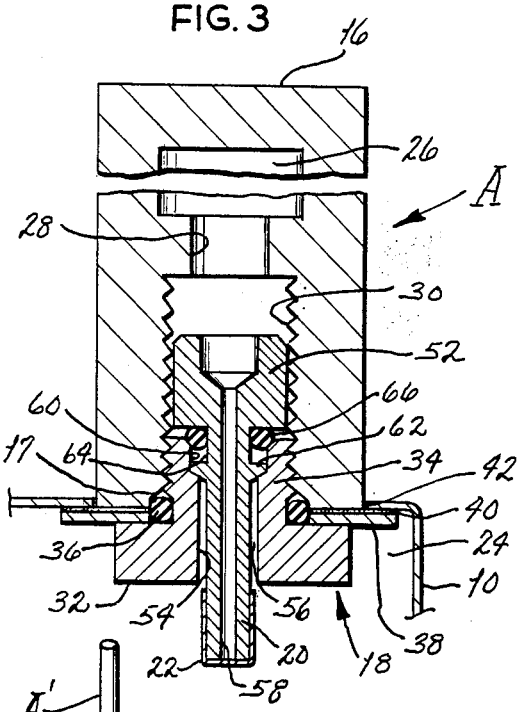
FIG. 4
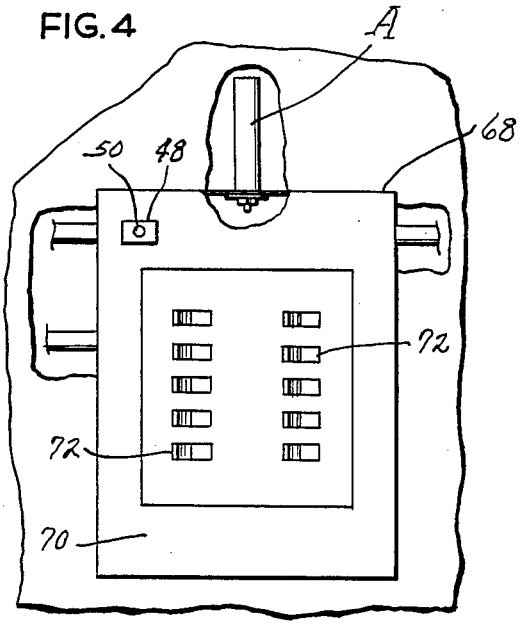
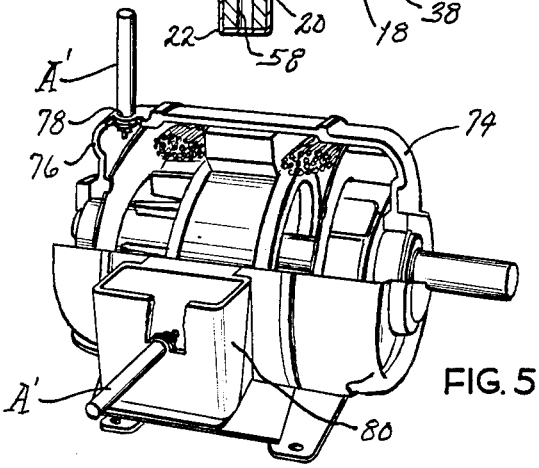
FIG. 5

COMPACT SELF-CONTAINED FIRE EXTINGUISHER

This application is a continuation of application Ser. No. 735,835, filed May 20, 1985, now abandoned.

BACKGROUND AND SUMMARY OF THE INVENTION

The invention relates to compact, self-contained fire extinguishing apparatus particularly for use in existing electrical equipment such as receptacle boxes, switchboxes, fuse boxes, electronic gear, motors and various other kinds of electrical equipment having a housing in which there is normally not sufficient space for incorporating a fire extinguisher into the housing.

Fire extinguishers useful for electrical equipment have been disclosed, as in Terry U.S. Pat. No. 3,403,733, and intended to discharge a fire extinguishing agent through ducting or discharge lines into the equipment housing. Indeed, fixed extinguisher systems for protecting electrical and mechanical equipment have long been known, as in Dunn U.S. Pat. Nos. 3,889,755, and 3,889,776. Such systems are neither practical nor feasibly useful for protecting numerous kinds of equipment such as household circuit breaker boxes, receptacle boxes and the like. The high cost and complexity of such prior art prohibits their use for such application. Because of cost, complexity and nonsuitability, such prior art systems and apparatus have not been used also for many commercial applications.

Accordingly, among the several objects of the invention may be noted the provision of compact selfcontained fire extinguishing apparatus; particularly such apparatus which is especially useful with electrical apparatus of the type including a housing for containment of electrical circuits and the like, which housing has limited space such as would normally be insufficient for incorporating a fire extinguisher within the housing; and the provisions of such aparatus which is intrinsically simple and economical so as to be practical and feasible for providing fire protection for numerous different kinds of equipment such as household circuit breaker boxes, receptacle boxes and the like, including electric motors as well as many other commercial installations.

Among still further objects of the invention are the provision of such apparatus which can be added by retrofitting to many different kinds of already operational or installed electrical equipment without substantial modification of such equipment; which does not interfere with normal operation or function of equipment with which used; and which can easily be replaced after protectively discharging into a housing for such equipment.

It is also an object of the invention to provide the combination of such fire extinguishing apparatus with means for indicating that such apparatus has discharged fire extinguishing substance contained therein, thereby to permit replacement of the discharged apparatus.

Other objects of the invention include the provision of such apparatus which can be installed simply and easily and which later may be replaced easily and quickly if discharged; which does not require high skill or expertise for installation or replacement; which is secure when installed; which is tamper-proof as well as operationally reliable when installed; and which is extremely economical in nature such as permits wide installation and use in myriad domestic and commercial applications which have heretofore not been protected by fire extinguishers.

Other objects and features of the invention will be in part apparent and in part pointed out below.

BRIEF DESCRIPTION OF THE DRAWINGS

FIG. 1 is a prospective view, partly cut-away, of compact, self-contained fire extinguishing apparatus according to, and embodying, the present invention.

FIG. 2 is a front elevation view of the apparatus of FIG. 1 as installed within a receptacle box, portions of which have been cut away for clarity.

FIG. 3 is an enlarged vertical cross-section of the new apparatus, as taken along line 3—3 of FIG. 2.

FIG. 4 is a front elevation view of the apparatus of FIG. 1 as installed within a circuit breaker box, portions of which similarly have been cut away for clarity.

FIG. 5 is a perspective view of a motor as fitted with the apparatus of FIG. 1, where portions of the motor similarly have been cut away.

Corresponding reference characters indicate corresponding parts throughout the several views of the drawings.

DESCRIPTION OF THE PREFERRED EMBODIMENTS

Referring now to FIGS. 1–3, a fire extinguisher of the invention is designated in its entirety at A. Extinguisher A is of compact, self-contained character for being installed in either existing or new electrical equipment. The new extinguisher is intended for protecting the interior of a housing or enclosure for electrical equipment, such as for example, a receptacle box in which are secured conventional receptacles 12, 12'.

Extinguisher A is provided, for this purpose, with an elongated cylindrical vessel 14 which is closed at one end 16 and defines at the other end an opening 17 in which there is received a fitting, which is designated generally at 18. Said fitting has at its outer end a stem or nozzle 20 having thermally activatable means thereon in the form of a cap 22 of fusible material adapted to melt at a predetermined temperature, whereby the contents of vessel 14 will be permitted to be discharged into the interior of the electrical equipment housing, such as into the interior 24 of receptacle box 10.

Preferably, the vessel 14 contains a pressurized halogenated hydrocarbon of the "FREON" type, such as that sold under the trade designation "HALON", as is well known to have characteristics suitable for extinguishing of electrical fires. Accordingly, such an extinguishing substance or agent is preferably retained within vessel 14 in liquified form, and will be caused to vaporize if cap 22 melts because of high temperature conditions such as caused by a fire within the housing.

Accordingly, since vessel 14 must maintain the extinguishing agent under pressure, the vessel is preferably formed of relatively high strength material, such as stainless steel or aluminum alloy, and the same may be machined, cast or otherwise formed by conventional technique to provide the relatively long, thin shape illustrated. The relative dimensions, which have a great deal to do with the marked utility and installation of the new extinguisher, are discussed below. The interior of vessel 14, as designated at 26, is preferably also cylindrical, and takes up most of the length of vessel 14.

Said interior 26 opens through a passage 28 into a neck 30 which is internally threaded for receiving said fitting 18. Said fitting includes a centrally apertured head 32 which is conventionally flatted to permit wrench tightening and including 34 which is threaded into neck 30. An O-ring 36 is fitted around stem 34 at the base of head 32 for providing a leak-proof, sealing relationship between fitting 18 and vessel 14. Interposed between head 32 and stem 34 is a washer-like mounting disc 38 of diameter substantially greater than that of vesel 14, so that such washer 38 extends well beyond the vessel for purposes presently appearing. Carried upon the inner face of the washer, i.e., the face oriented toward vessel 14, is an adhesive layer 40 such as in the form of a ring of double-sided adhesive tape and by which apparatus A may be secured to an electrical housing, such as receptacle box 10, with the major portion of vessel 14 extending outside the vessel, and only a minor portion, namely fitting 18 and said nozzle 20 with its fusible cap 22 thereon, extending within the housing. As shown in FIG. 3, apparatus A is mounted by means of said adhesive layer 40 within an aperture 42 such as that defined by a so-called knock-out which is conventionally provided in electrical apparatus, including receptacle boxes, junction boxes, baker or fuse boxes, and so forth. Although the size of such a knock-out may vary according to the type of electrical service and conduits could be connected to the electrical equipment, a frequently encountered knock-out diameter is approximately 0.875 in. or slightly greater. Accordingly, it is preferred that the diameter of vessel 14 be approximately 0.75 in. or certainly of diameter not exceeding that of the smallest typically-encountered knock-out utilized in domestic wiring as well as commercial installations. Preferably, the vessel diameter is slightly less than that of the usual knockout whereby the vessel may be extended through the aperture defined by such a knock-out even at a substantial angle. This permits the new extinguisher to be installed within an existing electrical housing, such as receptacle box 10, by simply removing the box cover 44, pulling the receptacles 12, 12' and wiring aside, and inserting apparatus A through the aperture 40 defined by having removed the knock-out. To permit such installation, the overall length of vessel 14 is preferably limited so as to provide an aspect ratio, i.e., the ratio of the length of the vessel to its diameter, which is about 6:1. Accordingly, the length of the vessel will not be such as to interfere with thinner wall structure, such as framing, gypsum board, etc., when inserted in the above-described manner. In the installation depicted in FIG. 2, apparatus A is extended up through aperture 42, being maintained in place by the adhesive layer 40 which adheres tightly to the inner surface of the receptacle box. Consequently, the major length of vesel 14 extends above the receptacle box 10. However, an opposite orientation may also be utilized, wherein the lower knock-out is removed, and apparatus A may instead be extended down through the receptacle box so that it extends, when installed, below the receptacle box. As is evident in FIG. 2, only fitting 18 and its capped nozzle 20 extend into the relatively limited space of the receptacle box.

After installation, as depicted, receptacles 12, 12' are returned to the configuration shown, and the cover 44 is affixed, as by the usual screw 46. As so installed, it is not apparent to the outside observer that apparatus A is in place and in readiness for protecting the interior of the receptacle box against any electrical fire. Thus, apparatus A is normally concealed in such usage and is tamper-proof.

If a fire should result within the receptacle box, causing the temperature therein to reach a level, such as 450° F., at which said fusible cap 22 will melt, the pressurized contents of vessel 14 will be discharged into the interior of the box for rapidly extinguishing the fire.

It is preferred to have such a relatively low melting point since such a temperature is characteristic of the ignition point for many materials such as paper, wood and the like, it being desired that the extinguishing agent be released if a fire has been initiated. It is not desired to release the agent merely if there is heating such as caused by heavy electrical demand, minor arcing, and other nonflammable conditions. In order to provide visual indication that there has been such extinguishing action of the new apparatus, it is preferred to mount upon the front cover, such as receptacle cover 44, a tell-tale in the form of a small adhesive area 48 having a spot 50 of a material which changes color when exposed to sufficiently high temperatures. Said spot 50 is preferably of a commercially available material which will exhibit a color change, such as turning from light to dark color, if exposed to a predetermined temperature which is preferably is considerably lower than the temperature at which said fusible cap 22 will melt. For example, such temperature at which change will occur may be relatively low, such as 135° F. Accordingly, the color change will result either from an overtemperature condition (which would not result in operation of the extinguisher) or from a fire (in which the temperature resulting would exceed the point at which the fusible cap 22 melts). Thus, if there has been a fire or excessive electrical heating within the protected electrical housing, the high temperature therein will cause said spot 50 to change and, as the temperature reaches the fusing temperature for cap 22, the contents of the fire extinguisher will be discharged to extinguish the fire. The user may readily later see that spot 50 has changed color, and will know to remove the spent extinguisher and replace it with a filled replacement. Such replacement is a simple matter of removing cover 44, in the example shown in FIG. 2, to gain access to the interior of the receptacle box, whereupon extinguisher A may be pried from its adhesively-maintained position, simply withdrawn, and then replaced by a fresh unit which is once again secured adhesively in place.

Fitting 18 is so designed as to permit both discharge and filling of the extinguisher. For this purpose, nozzle 20 is defined as the outer extremity of a valve body 52 and with said nozzle 20 being in the form of a thin, elongated stem extending outwardly from said body 22, with such stem having a diameter smaller than a central bore 54 defined within said head 32, whereby annular space 56 is defined around the length of stem 20. Stem, or nozzle 20 includes a central orifice 58 extending therethrough and opening into the base of body 52. Extension 34 defines an enlarged diameter portion 60 for receiving an annular flange 62 formed proximate the base of stem or nozzle 20, whereupon there is defined between said flange and body 52 a U-shaped seat 64 in which is seated an O-ring 66 for providing a sealing relationship around the base of the stem within member 34. Said O-ring is maintained in a compressed state by base 52 resulting from pressure exerted thereon by the extinguishing agent within vessel 14. However, as will be apparent, fluid may be forced into the interior 26 of the vessel by placing a suitable filling fixture around said nozzle 20 in sealing relationship against head 32, and causing the extinguishing substance, in liquid form, to be forced through said annular space 26, and so causing base 52 to be urged inwardly to permit unseating of O-ring 60. Thus, fluid may be forced into the vessel interior 26 until it is filled. When filling is completed, the internal pressure causes valve member 52 to move outwardly, reseating O-ring 66.

Referring now to FIG. 4, there is ilustrated an installation of apparatus A within a breaker box 68 such as of the type having a front panel 70 containing various circuit breaker switches 72 of conventional type. Once again, apparatus A is mounted by being inserted through the aperture defined by a knock-out of box 68. As shown, it is mounted in upright, vertical configuration, its major extent being above box 68. Alternatively, the new extinguisher may be mounted so that it extends below the box or instead may extend through the aperture defined by knock-out at either side of the breaker box. Such installation illustrates merely one of several possibilities for mounting of the new extinguisher, which may be utilized for protecting not only a circuit breaker installation as illustrated, but also fuse boxes, and junction boxes, etc. It may be mounted in any of a wide variety of housings for electrical equipment. The exterior of box 68 is similarly and preferably also provided with the telltale device 48 including a color-change spot 50 thereon as above described, to permit the user to know of operation of device A.

Referring to FIG. 5, there are illustrated two of the new fire extinguishers, as mounted for protecting an electric motor 74. A first such unit A′ is mounted in a bell housing 76 by being extending through an aperture 78 drilled or otherwise provided in the bell housing, whereby the major extent of the extinguisher is located outside of the bell housing, but with the above-described fitting and nozzle extending inwardly of the bell housing, whereby there will be protection for the leads, contacts and other electrical elements of the motor. Preferably, the arrangement is such that unit A′ is mounted in the bell housing in which there is an air intake for cooling of motor 74, rather than in the opposite bell housing through which the cooling air discharges.

A second unit A″ is mounted within an electrical connection box or housing 80 by which electrical connections are made for the motor. Unit A″ is shown representatively in horizontal orientation, having been inserted through a suitable aperture provided in said housing 80, such as through an aperture defined by removal of a knock-out.

In the various above-illustrated applications, it will be apparent that the novel configuration and relatively high aspect ratio of the new compact, selfcontained fire extinguisher of the invention makes it possible for it to be positioned with its major extent located exteriorly of a housing for electrical equipment, and with only the fitting, with its securement in the form of the adhesively-carrying washer, and nozzle, intruding into the limited space available. By virtue of its small size, replaceability and economical construction, the new extinguisher may be used in many domestic and commercial applications where it has never heretofore been practical to provide fire extinguishers for protective purposes. The above-described applications are merely representative of the many possible mounting arrangements which are made possible by the advantageous configuration and character of the new extinguisher.

In view of the foregoing, it will be seen that the several objects of the invention and other advantages are achieved by the new constructions which have been described.

Although the foregoing includes the description of the best mode of the embodiments contemplated for carrying out the invention, various modifications are contemplated.

As various modifications could be made in the constructions herein described and illustrated without departing from the scope of invention, it is intended that all matter contained in the foregoing description or shown in the accompanying drawing shall be interpreted as illustrative rather than limiting.

What is claimed is:

1. In combination with electrical equipment including a housing of limited space having a knock-out aperture and an interior surface surrounding the knock-out aperture, a compact, self-contained fire extinguisher for installment in the electrical equipment by mounting within the knock-out aperture characterized by the extinguisher comprising an elongated cylindrical vessel having a relatively high aspect ratio and having a diameter which at any point along the length of the vessel is less than the diameter of the knock-out aperature whereby the vessel is configured for extending through the knock-out aperture, the vessel containing a quantity of fire extinguishing substance under pressure, a nozzle at one end of the extinguishing substance under pressure, a nozzle at one end of the elongated vessel, thermally activatable means carried by the nozzle for permitting discharge of the fire extinguishing substance through the nozzle when thermally activated, the vessel being inserted in the knock-out aperture by extension of its nozzle-remote end through the knock-out aperture by extension of its nozzle-remote end through the knock-out aperture, and adhesive securement means including flange-defining structure at a nozzle end of the vessel for providing a securement flange presenting a securement surface of annular configuration and adhesively affixed to the securement surface for adhesively removably mounting the vessel by adhesion to the interior surface of the electrical housing surrounding the knock-out aperture with the nozzle-remote end is extending exteriorly of the electrical housing and with only the nozzle, thermally activatable means and adhesive securement means extending interiorly of the electrical housing for causing discharge of the fire extinguishing substance within the electrical housing, whereby the fire extinguishing apparatus is installable and removable solely from interiorly of the electrical housing.

2. Apparatus according to claim 1 and further characterized by said aspect ratio being 6:1.

3. Apparatus according to claim 1 and further characterized by the adhesive securement means comprising a fitting secured to one end of the vessel, the fitting having said nozzle therein, and a washer-like disc interposed between the vessel and fitting, the disc having a diameter greater than that of the vessel, the disc constituting the flange-defining structure, the disc carrying the adhesive.

4. Apparatus according to claim 3 and further characterized by the adhesive comprising a ring of double-faced adhesive material for removably adhesively affixing the disc to the interior surface of the housing.

5. Apparatus according to claim 1 and further characterized by the vessel having a fitting including the nozzle, and fusible material constituting the thermally activatable means and carried at an outer end of the nozzle for normally containing the fire extinguishing substance under pressure within the vessel, the fusible material melting upon reaching a predetermined temperature for permitting said discharge.

6. Apparatus according to claim 5 and further characterized by said nozzle being defined by a valve member having a stem which is centrally apertured to communicate with the interior of the vessel, the fusible material being in the form of a fusible cap fitted over an outer end of the stem.

7. Apparatus according to claim 6 and further characterized by the fitting being of bolt-like character including a head having a central bore for receiving the stem and a threaded extension threadably received by the vessel, the securement means comprising a securement element interposed between the head and vessel.

8. Apparatus according to claim 7 and further characterized by said central bore defining annular space around the stem for permitting filling of the vessel with said extinguishing substance in the form of liquid under pressure, the valve member carrying seal means for providing a sealed relationship relative to the threaded extension for maintaining the liquid under pressure within the vessel upon filling, the valve member being longitudinally slidable within the threaded extension for movement of the seal means to permit such filling.

9. Apparatus according to claim 7 and further characterized by the securement element being a washer-like disc carrying adhesive material on one face thereof, the disc being held captive relative to the vessel by said head.

10. Apparatus according to claim 1, the housing being provided with thermally responsive tell-tale means visible exteriorly of the housing for visually indicating the occurrence of an overtemperature condition interiorly of the housing.

11. Apparatus according to claim 10 wherein the housing includes a cover, the tell-tale means comprising a spot of material adhesively mounted exteriorly upon the cover, the spot exhibiting color change in response to said over-temperature condition.

* * * * *